US006189713B1

(12) United States Patent
Oh

(10) Patent No.: US 6,189,713 B1
(45) Date of Patent: Feb. 20, 2001

(54) COUPLER FOR LINKING A COACH WITH ANOTHER COACH IN A MINATURE TRAIN

(76) Inventor: Taek Rim Oh, 122/1410 Hyundai Apt Sankok 3 Dong, Bupyong-Ku Inchon (KR)

( * ) Notice: Under 35 U.S.C. 154(b), the term of this patent shall be extended for 0 days.

(21) Appl. No.: 09/229,717

(22) Filed: Jan. 13, 1999

(30) Foreign Application Priority Data

Jul. 29, 1998 (KR) ..... 98-14008

(51) Int. Cl.[7] ..... B61G 7/00
(52) U.S. Cl. ..... 213/75 TC
(58) Field of Search ..... 213/75 R, 75 TC; 105/1.5, 157.2, 238.2

(56) References Cited

U.S. PATENT DOCUMENTS 2,574,630 * 11/1951 Edwards et al. ..... 213/75 TC
3,469,713 * 9/1969 Edwards et al. ..... 213/75 TC
3,564,766 * 2/1971 Edwards et al. ..... 213/75 TC
3,605,332 * 9/1971 Stepek ..... 213/75 TC

* cited by examiner

*Primary Examiner*—Mark T. Le
(74) *Attorney, Agent, or Firm*—Baker Botts L.L.P.

(57) ABSTRACT

A coupler for linking a first coach to a second coach in a miniature train has a fixed member adapted to be affixed to an underframe of the coach and having an action groove and a coupler head part having a hook at a fore end thereof, the hook being adapted to join the first coach to the second coach. The coupler head has a coupler arm that is received in the action groove and that has a slot in the portion received in the action groove. A center pin on the fixed member is received in the slot in the coupler arm such that the coupler arm is pivotable about the center pin. A compression spring received in the slot of the coupler arm and having one end fixed to a first spring fixing pin on the center pin and the other end fixed to a second fixing pin on a rear end of the slot biases the coupler head part in the direction of the rear end of the slot. The coupler head part is movable against the bias of the spring in the direction of the fore end of the coupler head part such that the hook may move forward when the train moves along a curve.

1 Claim, 2 Drawing Sheets

COUPLER FOR LINKING A COACH WITH ANOTHER COACH IN A MINATURE TRAIN

BACKGROUND OF THE INVENTION

1. Field of the Invention

This present invention relates to a coupler for linking a coach and another coach in a miniature train, which has a plural of coaches, running on a given form of rail track, and more particularly, to a coupler of which a coupler arm is movable back and forth, right and left so that the said train may run with the interval between a coach and another coach being narrow like an actual train while it runs on a straight section of the rail track, and also of which a coupler arm gets to stretch forward out of the fixed member so that the said train may run smoothly with the interval between a coach and another coach being wide while it runs on a curve section of the rail track, and further of which a head is replaceable so easily that the coupler may be used compatibly for other miniature train products by replacing only the head of the coupler.

Generally, a miniature train comprises a plural of coaches like an actual train, and such miniature train gets to run on a given form of rail track while its wheels are spinning around by a power transmission means.

In the miniature train comprising a plural of coaches, a coach (2) and another coach (3) is linked by a coupler (1) as shown in FIG. 1. The conventional coupler comprises a fixed member (10) to be fixed to an underframe of a coach and a coupler head part (20). The fixed member (10) has an action room formed therein and it has also an axle rod, which is to be combined axially with a coupler arm of a coupler head part, built in a given position in the action room (11), and also, an elastic panel (13) is installed along with the inside wall of the action room of the fixed member, as shown in FIG. 2. The elastic panel enables the coupler head part to be centered at all times.

Meanwhile, as shown in FIG. 2, the coupler head part (20) has a hole (22) formed in the rear end of the coupler arm (21), through which the axle rod (12) as built in the action room is inserted for combination, and it has also a head (24) with a hook (23) in its fore end, which links a coach with another coach.

The linking of a coach with another coach by the said coupler is to be accomplished by locking the hook (23) of the head (24) of the coupler head part (20) with another hook each other while the fixed member (10) is fixed to the underframe of the coach by a fixing means.

Such miniature train, which has a plural coaches linked by the said coupler, gets to run on a given form of rail track while its wheels are spinning around by a power transmission means.

2. Description of the Related Art

Since the conventional coupler in the miniature train as abovesaid has the axle rod as formed in the fixed member inserted into and combined axially with the hole of the coupler arm of the coupler head part and thereby it gets to turn right and left only by a given angle, there are following problems; firstly, a length of the coupler arm of the coupler head part has to be lengthened so that the miniature train may run smoothly on a curved section of the rail track without any interference between a coach and another coach, and furthermore, the miniature train do not look like an actual train because the interval between a coach and another coach is too wide, which causes a difficulty in manufacturing a miniature train having a complete fine appearance; secondly, and since the coupler arm of the coupler head part is fixed axially to the fixed member, when the head of the coupler head part happens to be damaged, it is impossible to repair and maintain it, and furthermore, since the head of the coupler head part and the coupler arm are formed in one body, it can not be used compatibly for other miniature train models of other companies.

SUMMARY OF THE INVENTION

Therefore, an objective of this present invention is to provide a coupler for a miniature train of which a coupler arm of a coupler head part is movable back and forth in a fixed member, enabling the interval between a coach and another coach in a miniature train to get to be so narrow as if it looks like an actual train, by having the coupler arm of the coupler head part drawn back into the fixed member by repulsion of a spring while the miniature train is running on a straight section of a rail track, and further enabling the train to run smoothly on a curve section of the rail track by having the coupler arm of the coupler head part stretch forward out of the fixed member by leverage as caused by the two comers of two coaches when they bump against each other, while the miniature train is running on a curve section of the rail track, and further enabling a coupler to be used compatibly for linking coaches of other company's miniature trains by replacing only the head of the coupler arm, which is separable from the coupler arm of the coupler head part which is movable back and forth in the fixed member, with an applicable one.

This objective is to be accomplished by the coupler comprising a fixed member (110) to be fixed to an underframe of a coach and a coupler head part (120) having a hook (123) in its fore end, which links a coach (2) and another coach (3), wherein the fixed member (110) is fixed to the underframe of the coach by a fixing means, and it has an action groove (111) where a coupler arm (121) is movable back and forth, right and left, formed therein, and it has also a center pin (112) with a spring fixing pin (113) formed on its side wall, built on a given position in the said groove; and wherein the coupler head part (120) has the coupler arm (121) which is to be elasticized by a spring (125) of which an end is fixed to the spring fixing pin (113) and the other end is fixed to another spring fixing pin as formed on a rear end of a slot (124), and the spring (125) is installed in the slot (124) into which the center pin (112) of the fixed member (110) is inserted, and the coupler arm bar (121) has a hole (127) formed in its fore end side into which a head (122) with a hook (123) is inserted.

BRIEF DESCRIPTION OF THE INVENTION

DESCRIPTION OF THE PREFERRED EMBODIMENT

Hereinafter, this present invention will b e described by way of illustrative example with reference to the accompanying drawings.

Figure 1:
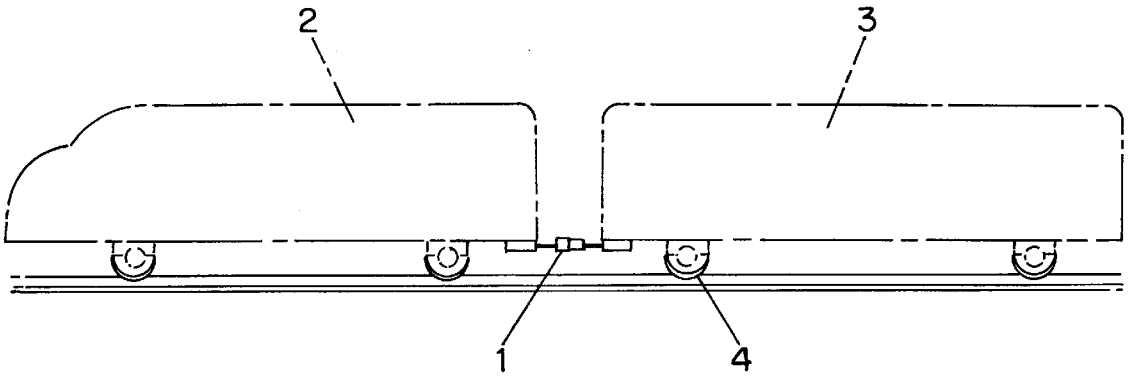
FIG. 1 PRIOR ART
FIG. 1 is a side view illustrating a part of a miniature train.
Figure 2:
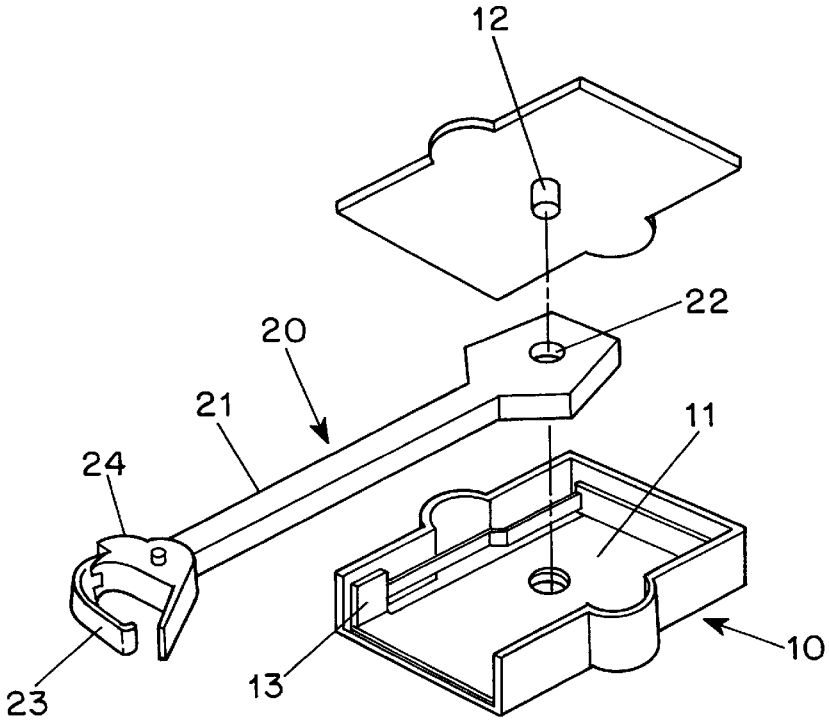
FIG. 2 PRIOR ART
FIG 2 is an exploded perspective view illustrating a conventional coupler of a miniature train.
Figure 3:
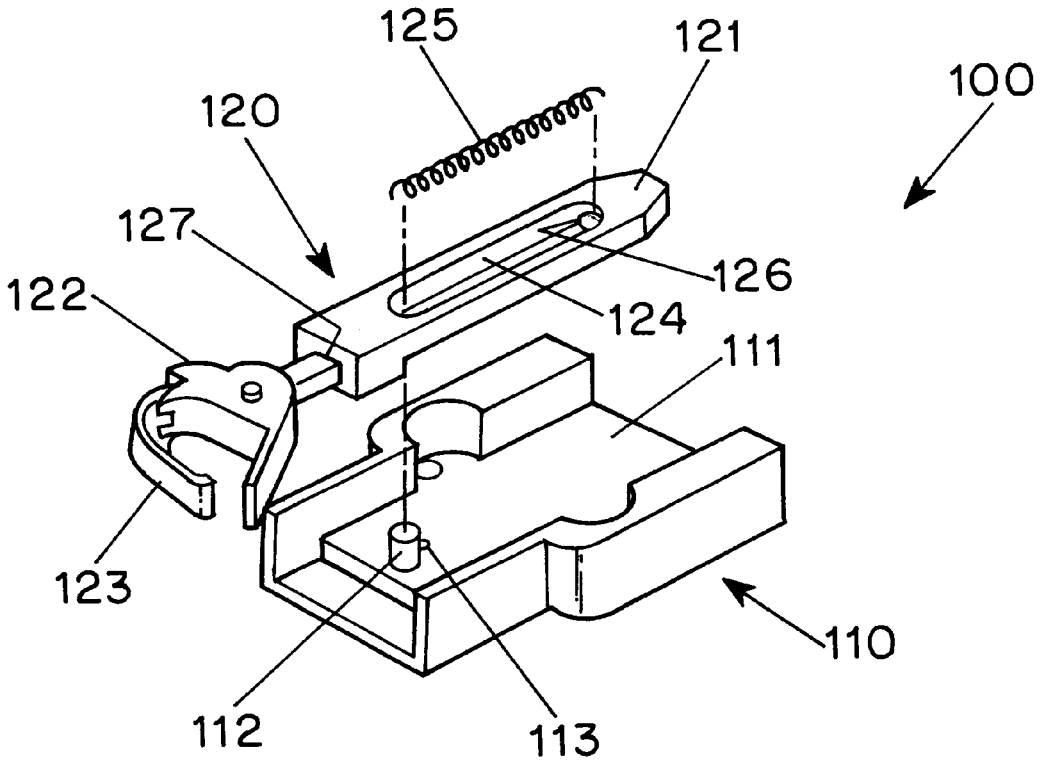
FIG. 3 is an exploded perspective view illustrating a coupler of a miniature train according to this invention.

As shown in FIG. 3, the coupler (100) of the miniature train according to this invention is to be assembled by inserting the center pin (112) of the fixed member (110) into the slot (124) as formed in the coupler arm (121) of the coupler head part (120) and fixing them, and then inserting the spring (125) into the slot (124), and then hanging one end of the spring (125) to the spring fixing pin (113) as formed on the sidewall of the center pin (112) and the other end of it to the other spring fixing pin (126) as formed in the slot.

As abovesaid, the coupler arm (121) is installed in the fixed member (110) and thereby the coupler head part (120) and the fixed member (110) are assembled into the coupler (100). And then the fixed member of the coupler is fixed to a fore end of an underframe of a coach and a rear end of it as well.

A miniature train is completely assembled into by linking a plural of coaches by the couplers (100) as installed in both ends of the underframe of the coach.

When a power switch of the complete miniature train as placed on a rail track, is turned on, a driving device gets to be operated by current of dry cells, and then the power of the driving device gets to be transmitted to the wheels of the train by a power transmission means, and thereby the miniature train gets to be running on the rail track.

While the miniature train is running on a straight section of the rail track, the coupler arm (121) of the coupler head part (120) gets to be drawn back into the fixed member (110) by repulsion of the spring (125) as installed in the slot (124), and thereby the miniature train gets to run with the interval between coaches being narrow, looking like as if an actual train is running on a rail track.

On the other hand, while the miniature train is running on a curve section of the rail track, the coupler arm (121) of the coupler head part (120) gets to stretch forward out of the fixed member (110) by leverage as caused by the two corners of two coaches when they bump against each other, and thereby the interval between coaches gets to be so wide that the train can run smoothly on the curve section of the rail track. While the said train is running on the curve section of the rail track, the spring (125) as installed in the slot (124) gets to be compressed.

When the miniature train gets back to run on the straight section of the rail track following the curve section thereof, the coupler arm (121) of the coupler head part (120) gets to be drawn back into the action groove (111) by repulsion of the spring (125), and thereby the train gets to run with the interval between coaches being narrow, as abovesaid. Like this, the miniature train runs on the rail track, reiterating such movements as above described depending upon what section of the rail track the train is running on.

In case the head (122) of the coupler (100) happens to be damaged, the damaged head (122) can be replaced with a new head after it is separated from the hole (127) as formed in the fore end side of the coupler arm (121) by heating the coupler arm (121), and since the head (122) is separable as abovesaid, this coupler is also available compatibly for linking coaches of other company's miniature trains by replacing only the head with other applicable one.

This invention shall not be limited to the preferred embodiment as above described, and anyone having a common knowledge in the field related to this invention, can implement a variety of modified embodiments without going beyond the purport of this invention.

As above mentioned, the coupler of the miniature train according to this invention has the following advantages; firstly, while the miniature train is running on a straight section of the rail track, the miniature train looks like as if an actual train is running on the rail track because the coupler arm of the coupler head part gets to be drawn back into the fixed member by the repulsion of the spring and thereby the miniature train gets to run with the interval between coaches being narrow, and on the other hand, while the miniature train is running on a curve section of the rail track, the coupler arm of the coupler head part gets to stretch forward out of the fixed member by leverage as caused by the two comers of two coaches when they bump against each other, and thereby the train can run smoothly on the curve section of the rail track; secondly, since the head is separable from the coupler arm of the coupler head part which is movable back and forth, right and left in the fixed member, this coupler is also available compatibly for linking coaches of other company's miniature trains by replacing only the head with other applicable one.

What is claimed is:

1. A coupler for a linking a first coach to a second coach in a miniature train, comprising a fixed member adapted to be affixed to an underframe of the coach and having an action groove, a coupler head part having a hook at a fore end thereof adapted to link the first coach to the second coach, the coupler head part including a coupler arm received in the action groove, the coupler arm including a hole in its fore end, the coupler head part including a coupler head part portion received in said hole, a slot in the portion of the coupler arm received in the action groove, a center pin on the fixed member received in the slot in the coupler arm such that the coupler arm is pivotable about the center pin, and a compression spring received in the slot of the coupler arm and having one end fixed to a first spring fixing pin on the center pin and the other end fixed to a second fixing pin on a rear end of the slot such that the coupler head part is biased in the direction of the rear end of the slot and is movable against the bias of the spring in the direction of the fore end of the coupler head part.

* * * * *